US009108795B2

(12) United States Patent
Edwards et al.

(10) Patent No.: US 9,108,795 B2
(45) Date of Patent: Aug. 18, 2015

(54) METHOD FOR TRANSPORTING CONCENTRATED MASS LOADS BY CONTAINER

(75) Inventors: Robert A. Edwards, Hamilton (CA); Tony Guo, Hamilton (CA)

(73) Assignee: Carego Innovative Solutions, Inc. (CA)

( * ) Notice: Subject to any disclaimer, the term of this patent is extended or adjusted under 35 U.S.C. 154(b) by 1278 days.

(21) Appl. No.: 12/845,264

(22) Filed: Jul. 28, 2010

(65) Prior Publication Data

US 2011/0132785 A1 Jun. 9, 2011

Related U.S. Application Data

(60) Provisional application No. 61/266,750, filed on Dec. 4, 2009.

(51) Int. Cl.
*B65G 61/00* (2006.01)
*B65D 90/00* (2006.01)

(52) U.S. Cl.
CPC ..... *B65D 90/006* (2013.01); *B65D 2590/0058* (2013.01)

(58) Field of Classification Search
None
See application file for complete search history.

(56) References Cited

U.S. PATENT DOCUMENTS 4,834,000 A 5/1989 Darnell
4,976,365 A 12/1990 Seo
5,170,721 A 12/1992 Troth et al.
5,355,813 A 10/1994 Darnell et al.
5,799,585 A 9/1998 Brennan, Jr. et al.
6,041,714 A 3/2000 Trent et al.
6,068,146 A 5/2000 Trent et al.
6,206,214 B1 3/2001 de Koning et al.
6,219,987 B1 4/2001 Trent et al.
6,231,284 B1 5/2001 Kordel
6,389,985 B1 5/2002 Trent
6,396,020 B1 5/2002 Thelen et al.
6,422,794 B1 7/2002 Zhan et al.
6,494,651 B1 12/2002 Zhan et al.
6,503,037 B2 1/2003 Thomson et al.
6,515,249 B1 2/2003 Valley et al.
6,523,483 B1 2/2003 Trent (Continued)

OTHER PUBLICATIONS http://www.oocl.com/mexico/eng/localinformation/operationalrestrictions/Documents/BNSF container Canada Guildelines.pdf.

(Continued)

*Primary Examiner* — Saul Rodriguez
*Assistant Examiner* — Willie Berry, Jr.
(74) *Attorney, Agent, or Firm* — Young Basile Hanlon & MacFarlane P.C.

(57) ABSTRACT

A cradle for use with a load-bearing pallet and a shipping container is disclosed and comprises a support portion, an arresting portion and a base portion. The support portion, in use, is disposed beneath and supporting the pallet. The pallet, in use, is disposed in the container between the container sides. The arresting portion, in use, arrests horizontal sliding motion of the pallet relative to the support portion. The base portion, in use, is disposed on the floor of the container and spreads the load of the pallet, the support portion and the arresting portion over the floor of the container to within the capacity of the container. The base portion further is adapted to permit the pallet to be deposited onto and removed from the support portion by the truck using the rear doors of the container. A method for shipping steel coils using the cradle is also disclosed.

11 Claims, 7 Drawing Sheets

(56) References Cited

U.S. PATENT DOCUMENTS

| | | | |
|---|---|---|---|
| 6,533,511 | B1 | 3/2003 | de Koning |
| 6,585,466 | B2 | 7/2003 | Zhan et al. |
| 6,694,894 | B1 | 2/2004 | Darnell |
| 6,709,209 | B2 | 3/2004 | Zhan et al. |
| 6,767,169 | B2 | 7/2004 | Zhan et al. |
| 6,787,726 | B2 | 9/2004 | Thelen et al. |
| 6,808,346 | B2 | 10/2004 | Zhan et al. |
| 6,860,685 | B2 | 3/2005 | Thomson et al. |
| 6,886,470 | B2 | 5/2005 | Norby et al. |
| 6,948,896 | B2 | 9/2005 | Zhan et al. |
| 6,974,164 | B2 | 12/2005 | Brewster |
| 7,007,561 | B1 | 3/2006 | Otto et al. |
| 7,114,898 | B2 | 10/2006 | Brewster |
| 7,123,990 | B2 | 10/2006 | Thelen |
| 7,253,380 | B2 | 8/2007 | Miller |
| 7,337,682 | B2 | 3/2008 | Otto et al. |
| 7,367,765 | B2 | 5/2008 | Frett |
| 7,618,221 | B2 | 11/2009 | Thomson et al. |
| 7,837,046 | B2 | 11/2010 | Brewster |
| 2003/0129039 | A1 | 7/2003 | Zhan et al. |
| 2003/0133767 | A1 | 7/2003 | Zhan et al. |
| 2005/0286986 | A1 | 12/2005 | Thomson et al. |
| 2007/0012588 | A1 | 1/2007 | Smolenski et al. |
| 2007/0212185 | A1 | 9/2007 | Frett et al. |
| 2007/0251934 | A1 | 11/2007 | Kral et al. |
| 2008/0003076 | A1 | 1/2008 | Brewster |

OTHER PUBLICATIONS http://www.cpr.ca/en/customer-centre/safety/Documents/cp-customer-safety-handbook.pdf.

METHOD FOR TRANSPORTING CONCENTRATED MASS LOADS BY CONTAINER

CROSS-REFERENCE TO RELATED APPLICATION

This application claims the benefit of U.S. provisional patent application Ser. No. 61/266,750 filed Dec. 4, 2009.

FIELD OF THE INVENTION

The present invention relates to the transportation of concentrated mass loads by container and a cradle for use in transporting concentrated mass loads by container. The invention has application to the transportation of, inter alia, steel coils and other concentrated mass cargo, such as granite.

BACKGROUND OF THE INVENTION

It is known to ship steel coils by container. However, placing, for example, a 19,000 lb. coil of steel upright on a conventional 42"×48" pallet would impart localized loading on a standard container floor which would exceed its design capacity. As well, although open frame containers have been developed which permit side loading or loading by way of a crane, there are relatively few of these containers in circulation. Accordingly, known methods for shipping steel coils often involve relatively expensive pallets which are loaded with coils, which are slid or rolled into a container for use and which spread the load of the coils over the container floor.

SUMMARY OF THE INVENTION

A method for use with a coil-bearing pallet, a shipping container and a forklift truck forms one aspect of the invention. This method comprises the steps of: fitting into the container a cradle adapted to receive the coil-bearing pallet and to spread the load of the coil-bearing pallet over the floor of the container; reinforcing the floor of the container using a set of plates to permit the forklift truck to place the coil-bearing pallet onto the cradle; placing the coil-bearing pallet onto the cradle using the forklift truck; and securing the coil against movement within the container with restraints, to produce a containerized coil.

Forming yet another aspect of the invention is a method for use with a forklift truck and with a coil-bearing pallet secured in a container on a cradle by restraints, the method comprising the steps of: releasing the restraints; reinforcing the floor of the container using a set of plates to permit the forklift truck to remove the coil-bearing pallet from the cradle; and removing the coil-bearing pallet from the cradle using the forklift truck.

Forming a further aspect of the invention is a method for transporting three steel coils between a shipping location and a receiving location, each coil being in excess of 14,200 lbs. This method comprises the steps of: fitting into a shipping container three cradles, each adapted to receive a respective one of the coils and to spread the load of said one of the coils over the floor of the container to within the carrying capacity of the container; placing onto each cradle the coil which it is adapted to receive; securing the coils against movement relative to the container; and shipping the container between the shipping location and the receiving location.

A cradle for use with a load-bearing pallet and a shipping container forms yet another aspect of the invention. The cradle comprises a support portion, an arresting portion and a base portion. The support portion, in use, is disposed beneath and in supporting relation to the pallet. The load-bearing pallet, in use, is disposed in the shipping container in a position midway between the sides of the container. The arresting portion, in use, arrests horizontal sliding motion of the pallet relative to the support portion. The base portion, in use, is disposed on the floor of the shipping container and spreads the load of the load-bearing pallet, the support portion and the arresting portion over the floor of the shipping container to within the capacity of the shipping container. The base portion further is adapted to permit the load-bearing pallet to be deposited onto and removed from the support portion by a forklift truck using the rear doors of the container.

According to yet another aspect of the invention, the cradle can be used for transporting coil steel.

Other advantages of the present invention will become evident upon review of the accompanying detailed description and drawings, the latter being briefly described hereinafter.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
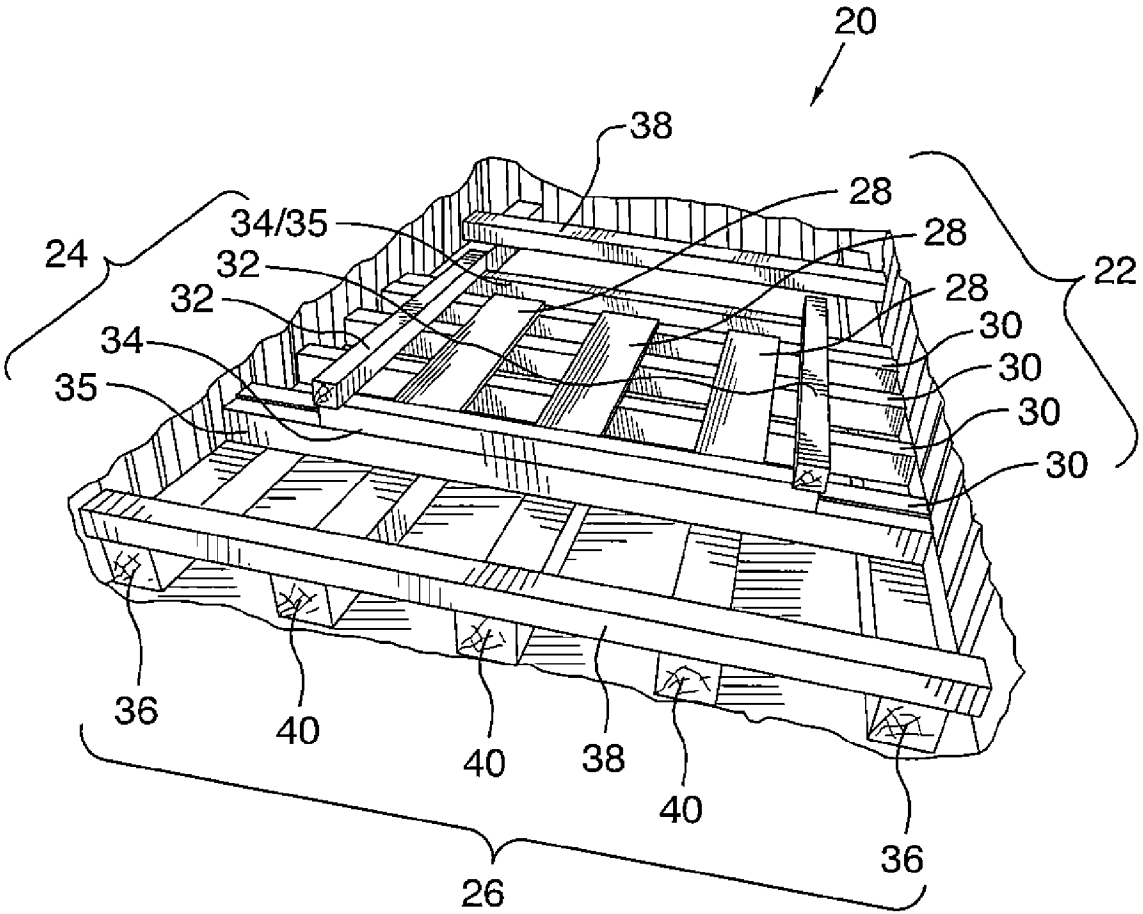
FIG. 1 is a perspective view of an exemplary cradle embodying the invention.

As indicated above, FIG. 1 is a perspective view of an exemplary cradle 20 embodying the invention.

This exemplary cradle 20 will be seen to include a support portion 22, an arresting portion 24 and a base portion 26.

The support portion 22 comprises three panels 28 of ¾ plywood and four pieces 30 of dimensional hardwood lumber. The support pieces 30 are each approximately 7'×4"×4", arranged parallel to one another and spaced apart so that the outermost surfaces of the outermost pieces are 50" apart from one another. This distance is indicated as A on FIG. 1A. The plywood panels 28 surface and are laid cross-wise across the support pieces 30.

The arresting portion comprises another six pieces 32, 34, 35 of dressed and dimensional lumber. Two of these pieces 35 are arranged parallel, outside and abutting to the outermost support pieces 30. Upon these pieces 35 lay pieces 34, which are softwood each about 55"×3.5"×3.5". These latter two pieces 34 are disposed parallel to the support pieces 30 and spaced apart so that their innermost surfaces are about 50" apart from one another. This distance is indicated by C on FIG. 1A.

The remaining two pieces 32 are softwood about 49"× 3.5"×3.5", lay crosswise of and centrally spaced upon pieces 34, parallel to one another and spaced apart so that their innermost surfaces are about 44" apart from one another. This distance is indicated as B on FIG. 1A.

The base portion comprises another seven pieces 36, 38, 40 dimensional lumber:

two of these pieces 36 are outrigger pieces;

two of these pieces 38 are laterals; and the three remaining pieces 40 are skid elements.

Each outrigger 36 is approximately 10'×6"×6". These are arranged parallel to one and spaced apart so that their innermost edges are about 72" apart from one another. This dimension is indicated as D on FIG. 1A. The support pieces 30 are supported on the outriggers 36 and span to the outer edges thereof, with the outermost surfaces of the support pieces 30 being, respectively, about 3'8" and 2'4" away from the ends of the outriggers 36, these distances, respectively, being indicated by E, F on FIG. 1A.

The laterals 38 are each about 89"×4"×4". These are disposed parallel to the support pieces 30, upon the outriggers 36 and spaced apart so that their innermost surfaces are 7'4" apart from one another, as indicated by G on FIG. 1A, with one of the laterals 38 being disposed at the end of the outriggers 36 which is 2'4" away from the support pieces and the laterals 38 evenly overlapping the outriggers 36.

The skid elements 40 are each approximately 84"×6"×6". The skid elements 40 are arranged parallel to one another and to the outriggers 36, are disposed centrally between the outriggers 36, span beneath the laterals 38 and are equally spaced from one another such that their outermost surfaces are 3'8" apart, this dimension being indicated by H on FIG. 1A.

The various dimensional lumber pieces are secured to one another wherever they intersect by carriage bolts to form a rigid assembly, and the plywood is rigidly secured to the assembly by screws. The plywood panel 28 are indicated in phantom outline in FIG. 1A, for clarity.

The cradle 20 can advantageously be used to transport steel coils by container.

In one exemplary method, three of these cradles are used to transport three steel coils, each between about 14,000 and about 19,000 lbs., between a shipping location and a receiving location, each steel coil being palletized on a 44"×50" pallet and each of the shipping and receiving locations having a forklift truck and a shipping dock.

As an initial step in the method, a standard 40' high stress marine container of 5 years of age or less and carried by a road chassis is brought into a loading position against the loading dock at the shipping location by a tractor or the like. In this position, the rear doors of the container are open, and the dock leveler provides a path for a forklift truck into the interior of the container.

Thereafter, the container is loaded from the front to the rear, through the rear door of the container, according to the following loading method substeps which are carried out, in seriatim:

i. placement of the frontmost cradle;

ii. reinforcement of the floor from the rear doors to the frontmost cradle;

iii. placement of the frontmost palletized coil by forklift truck;

iv. removal of the floor reinforcement to a position immediately rearward of the ultimate location of the middle cradle;

v. placement of the middle cradle;

vi. placement of the middle coil by forklift truck;

vii. removal of the floor reinforcement to a position immediately rearward of the ultimate location of the rearmost cradle;

viii. placement of the rearmost cradle;

ix. placement of the rearmost coil by forklift truck; and x. removal of the remaining floor reinforcement.

As a further substep (xi) of the method, the coils are secured to the container.

Figure 2:
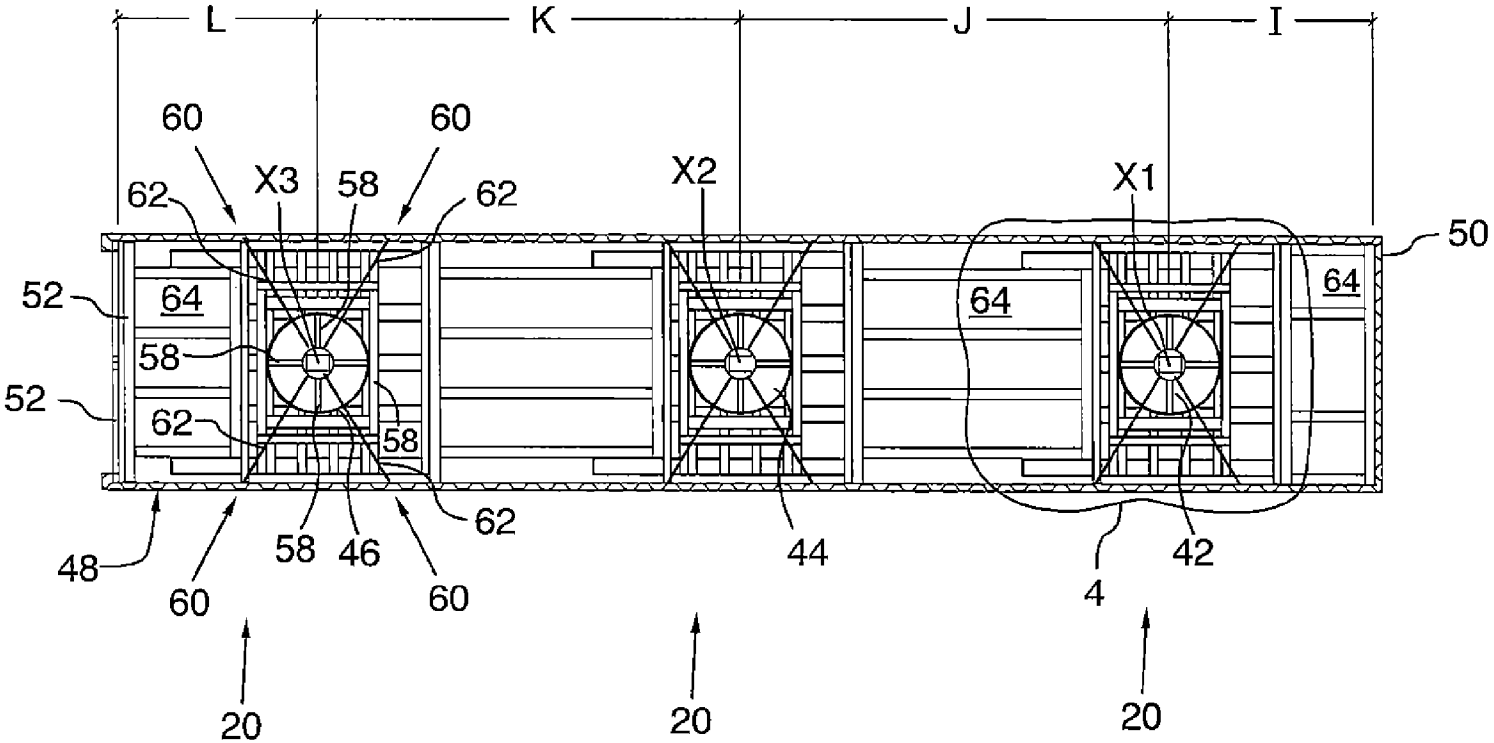
FIG. 2 is a plan view of the interior of a container, showing the end result of a loading method in which the cradle of FIG. 1 can be used.

With regard to substeps (i), (v) and (viii), and with reference to FIG. 2, which shows, in plan, the coils 42, 44, 46 and cradles 20 after the completion of the loading method, each cradle 20 is positioned such that:

the coils 42, 44, 46, once positioned, are centered widthwise in the container 48;

the axis of the frontmost coil 42 is 6'-7.5" [I] from the front wall 50 of the container;

the axis X2 of the middle coil 44 is 13'-2.5" [J] from the axis X1 of the frontmost coil 42; and the axis X3 of the rearmost coil 46 is 13'-2.75" [K] from the axis X2 of the middle coil 44 and 6'-¾" [L] from the rear doors 52.

Figure 1A:
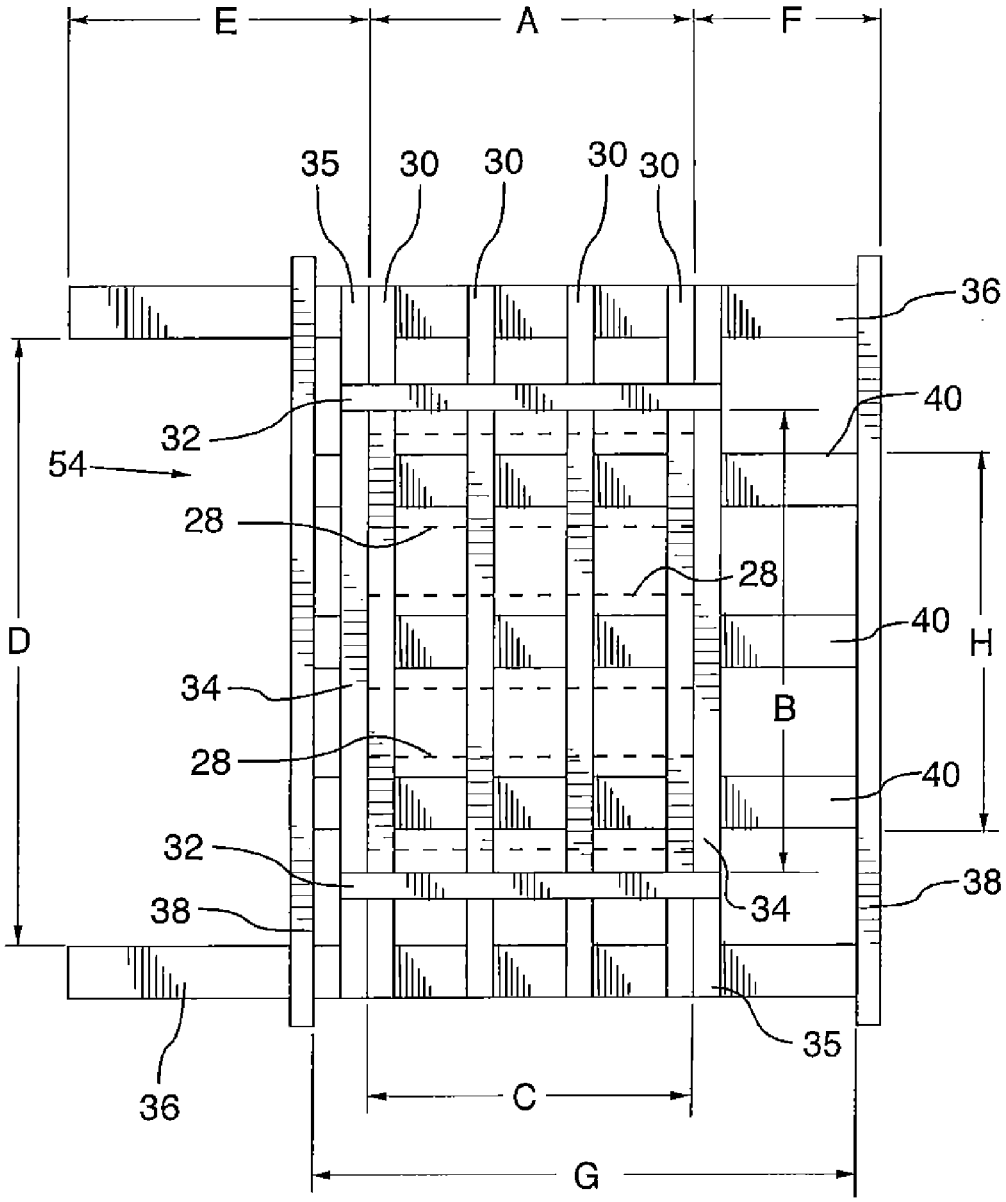
FIG. 1A is a plan view of the structure of FIG. 1A, partially in phantom, for clarity.
Figure 3:
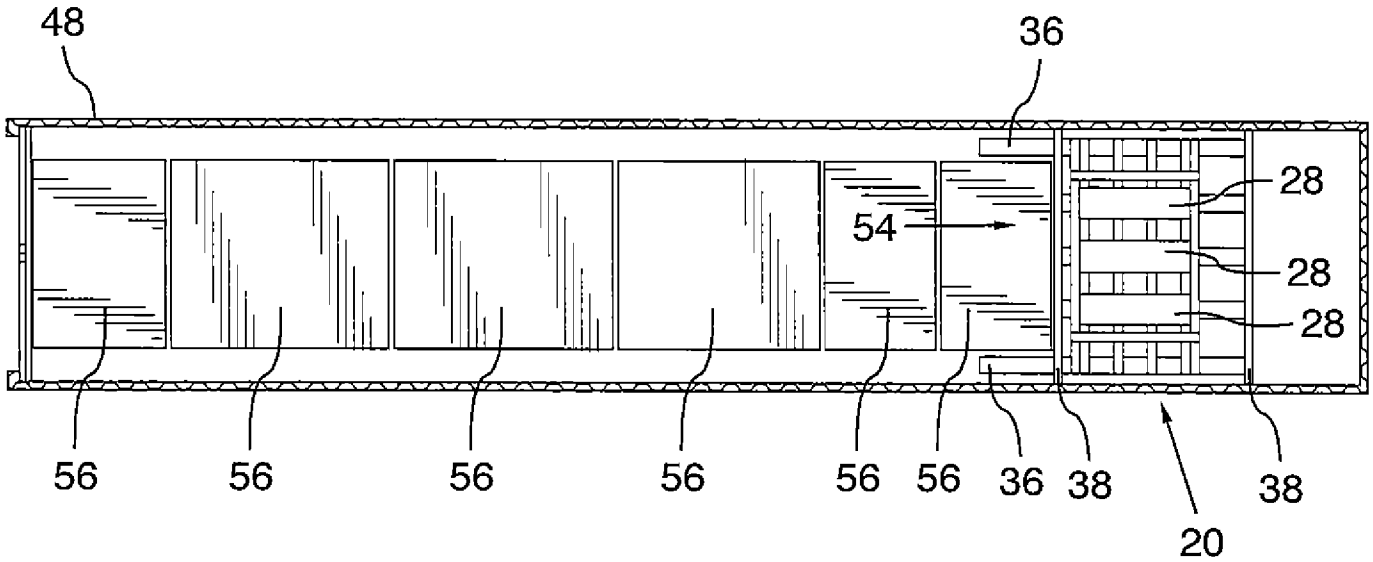
FIG. 3 is a plan view of the interior of a container as it appears at an earlier point of the loading method.
Figure 4:
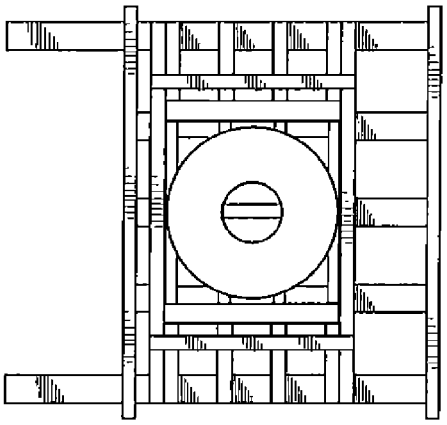
FIG. 4 is an enlarged view of encircled area 4 of FIG. 2.
Figure 5:
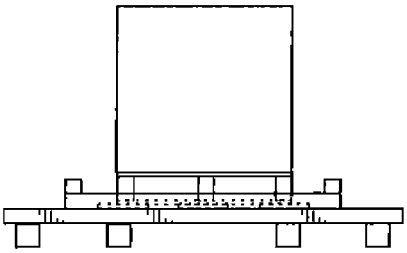
FIG. 5 is a side view of the structure of FIG. 4.
Figure 6:
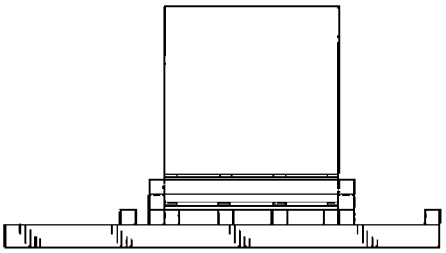
FIG. 6 is a front view of the structure of FIG. 4.
Figure 7:
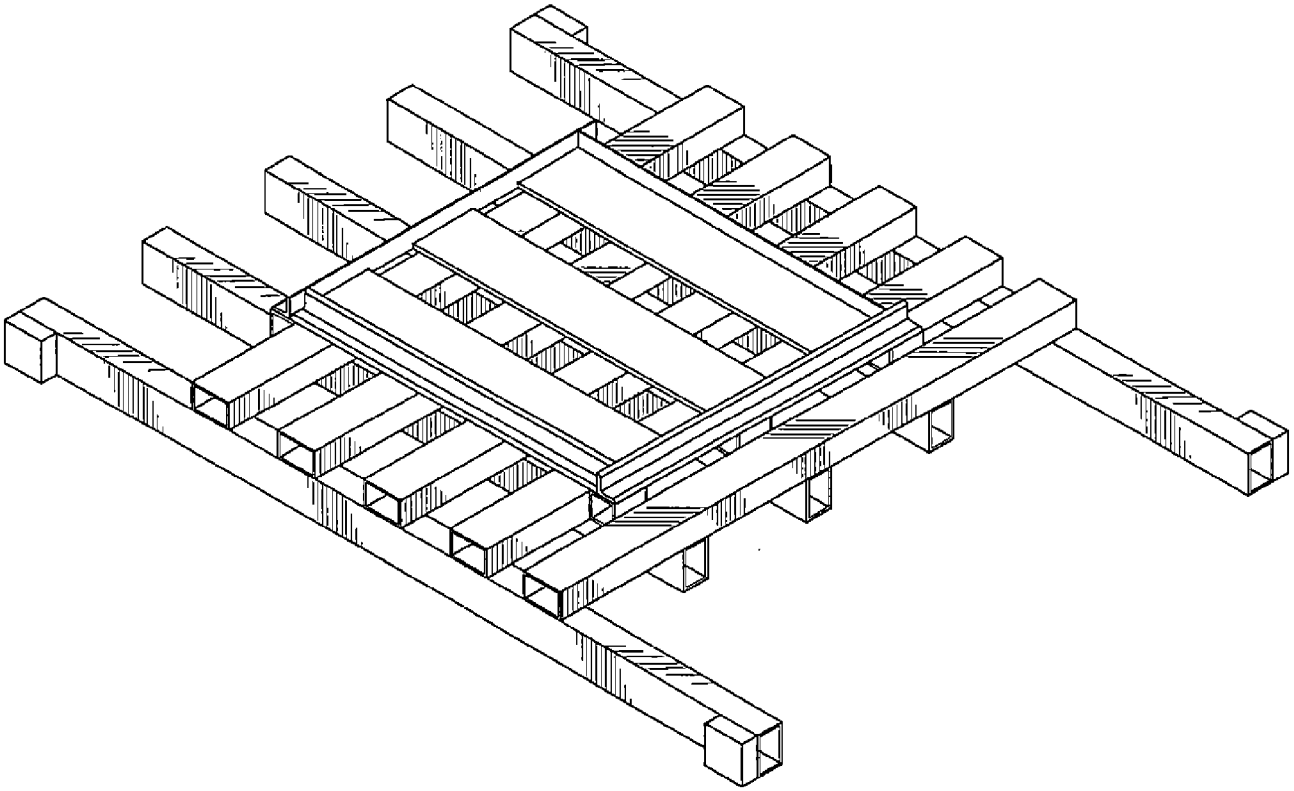
FIG. 7 is a perspective view of a cradle according to another exemplary embodiment of the invention.
Figure 8:
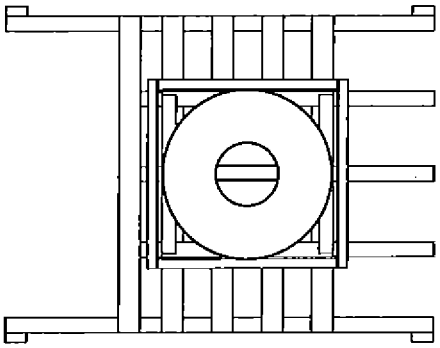
FIG. 8 is a plan view of the cradle of FIG. 7, with the outline of a coil of steel superimposed thereon.
Figure 9:
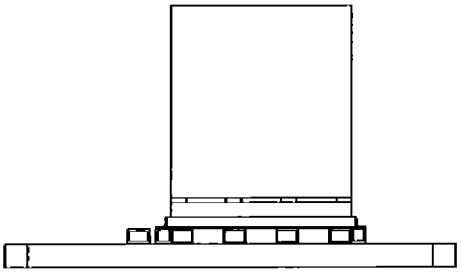
FIG. 9 is a side view of the structure of FIG. 8.
Figure 10:
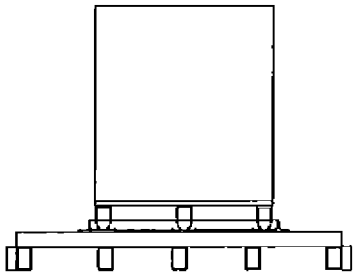
FIG. 10 is a front view of the structure of FIG. 8.

With regard to substeps (iii), (vi) and (ix):

each coil is placed on the support pieces, between the pieces of dimensional lumber which collectively define the arresting portion, such that: the support portion is disposed beneath and in supporting relation to the pallet of the palletized steel coil; the arresting portion arrests horizontal sliding motion of the palletized steel coil relative to the support portion; and the base portion spreads the load of the palletized steel coil, the support portion and the arresting portion over the floor of the shipping container to within the capacity of the shipping container;

during placement of a coil on a cradle, the forklift truck (not shown) enters a drive-in area 54 of the cradle which is defined between the outriggers and immediately longitudinally rearwardly adjacent the support portion (the drive-in area is shown on FIG. 3 and on FIG. 1A)

the heaviest coil is disposed over the chassis wheels; and the lightest coil is disposed between the other two coils.

With further regard to the placement of the palletized coil on the cradle, it should be noted that the skids of the pallet substantially overlie the skid elements of the cradle, which has some advantage in terms of load capacity.

With regard to substeps (ii), (iv), (vi) and (x), the floor reinforcement in the exemplary method takes the form of a set of ⅜" steel plates which lie on the floor of the container and spread the load of the forklift truck and the coil it carries over the floor of the container so as to avoid bursting. The plates are preferably about 6' wide, so as to easily accommodate forklift travel. The plate lengths are ideally at least 4', so as to span three or more of the channels which define the container base, but lengths can vary. Preferably, the lengths will be adjusted, so that, as loading progresses, plates can be removed, to make room for the next cradle, while maintaining a reinforced path for the forklift truck.

For greater reference, FIG. 3 shows, in plan, the interior of the container 48 of FIG. 2, just before the placement of the frontmost coil; leading to the frontmost cradle 20 are reinforcing plates 56.

With regard to (xi), as further substeps of the loading method, as shown in FIG. 2:

each coil is secured to the cradle, by four bands 58 of sufficient strength to at least equal the coil static weight;

each coil is secured to the container anchor lashings 60 with four chains 62 of sufficient strength and numbers to at least equal the coil static weight; and blocking 64 is fitted around the cradles, to block same against sliding movement within the container.

These substeps can be done at any time, but are preferably done in stages, as loading progresses.

As further steps of the transport method, after the loading method has been carried out:

the container is shipped in a conventional manner between the shipping location and the receiving location; and the coils are removed from the container at the receiving location, by carrying out an unloading method which is analogous to the loading method but reversed.

Persons of ordinary skill will appreciate that the foregoing provides a method for transporting steel coils of substantial advantage:

containerization protects the coils from weather during transport;

containerization allows for relatively inexpensive transport by sea, road and rail;

the cradle is relatively inexpensive in comparison to many known load-and-roll pallets;

the loading and unloading steps can be carried out without the need for an expensive overhead crane and with fork-lift trucks; and the method permits the use of relatively commonplace 40' marine containers.

On the matter of the forklift trucks, these should be capable of carrying the loads in question and sized for use within the container intended to be used. Forklift trucks can be commonly sourced to custom specifications, and attaining the present requirements is a matter of routine to manufacturers thereof.

Without intending to be bound by theory, it is believed that some of the advantage of the exemplary cradle flows from dual functionality of the piece 38 which lies closes to the drive-in area 54 of the cradle; this element 38, which forms part of the support portion 22, also co-acts with base portion 26, in that piece 38 helps to integrate skid elements 40 with the outrigger pieces 36 and helps to spread the load.

Whereas but a single embodiment of the cradle is shown, and but a single embodiment of the transportation method is described, persons of ordinary skill in the art will readily appreciate that variations are possible.

A steel cradle is shown, for example, in FIGS. 7-10. This cradle is relatively durable, so as to be reusable for many years. At the same time, a steel cradle would still be relatively inexpensively in comparison to known load-and-roll pallets and, in some situations, could be economically used only once and thereafter recycled as scrap. Cradles of aluminum or softwood could also be used.

As well, whereas a specific construction for a wood pallet is detailed, other variations therein could be made.

Further, whereas the exemplary method contemplates loading and unloading as taking place on a loading dock, with the container supported on a road chassis, this is not necessary. It would, for example, be conceivable that the container could be handled at one of the shipping and receiving locations by, for example, an overhead crane, and loaded at grade. In these situations, reinforcement of the container floor would not be required.

Additionally, whereas steel plates are described for reinforcement, this is merely a convenient and relatively inexpensive solution. Other reinforcements, such as grills, lattices, corrugated panels, etc., could all be employed, as could materials other than steel, for example, aluminum or carbon fiber.

Yet further, whereas a specific shipping arrangement, of 3 coils in a 40' container is described, other variations can be made.

For example, in a 40' container, fewer than three coils, each in excess of 14,200 lbs. could also be shipped, with suitable blocking.

Pallets smaller than 44"×50", for example, can be used with the cradle; a 42"×48" pallet, for example, can be conveniently used.

As well, the illustrated cradles could be used in a 20' container, with suitable changes to the blocking.

Additionally, if the present cradle was shortened by 6", two of these cradles could be fitted in a 20' cradle, with 4" of T-bracing at the door; in this case, the maximum load carried by these cradles would be reduced to 18,500 lbs.

Further, the cradle can be used in combination with other palletized loads in a single container. Smaller coils, for example, in the range 4000-14,200 lbs., can be interspersed in amongst coils carried by the inventive cradle. For example, in a 40' container, two conventional pallets could each carry a coil of less than 14,200 lbs., and two coils in excess of 14,200 lbs. could each be carried by a respective cradle of the present invention.

Accordingly, the invention should be understood as limited only by the accompanying claims, purposively construed.

What is claimed is:

1. A method for loading a coil-bearing pallet into a shipping container having a floor and an entry suitable for admitting a forklift truck, the method comprising the steps of:

fitting into the container and on the floor thereof at a first distance of the entry within the container a cradle configured to receive a coil-bearing pallet;

reinforcing the floor of the container between the entry and the cradle using a set of plates to permit a forklift truck to place a coil-bearing pallet into the cradle;

placing a coil-bearing pallet onto the cradle by driving the forklift truck over the plates;

securing the coil against movement within the container with restraints and; removing the plates.

2. A method according to claim 1 wherein the container is supported by a road chassis during the placing step.

3. A method for use with the containerized coil produced according to claim 1, the method comprising the step of shipping the containerized coil to produce a delivered product.

4. A method according to claim 1 wherein the container is a standard marine container.

5. A method according to claim 1 wherein the cradle is constructed substantially out of wood.

6. A method of unloading a coil-bearing pallet from a container having a floor and an entry suitable for allowing entry of a forklift truck wherein the coil rest on a pallet which in turn rests on the cradle and is secured to the container by restraints, the method comprising the steps of:

releasing the restraints;

reinforcing the floor of the container between the entry and the cradle using a set of plates to permit the forklift truck to approach and on-load the coil-bearing pallet and lift the coil-bearing pallet from the cradle; and removing the coil-bearing pallet from the container using the forklift truck by driving the forklift truck back over the plates wherein the cradle remains in the container.

7. A method according to claim 6 wherein the container is supported by a road chassis during the removing step.

8. A method of loading heavy steel coils into a shipping container enterable over a floor by a forklift truck from an entry position aid configured to be capable of holding at least two such coils in first and second longitudinally spaced apart coplanar locations at first and second distances along the floor from said entry comprising the step of:

placing a first coil receiving cradle in the first location wherein said cradle has at least two levels of parallel beams in crosswise relationship;

placing reinforcing means on the floor of the container between the entry and the first cradle; loading a first coil on a first pallet using a forklift truck, driving over the reinforced floor from the entry to the first location and placing a first coil-loaded pallet onto to the first cradle;

removing the portion of the floor reinforcement between the first and second locations;

placing a second multilevel coil receiving cradle in the second location;

loading a second coil onto a second pallet;

using a forklift truck, driving over the shortened reinforced floor from the entry to the second location and placing a second coil-loaded pallet onto the second cradle, and removing the remainder of the floor reinforcements.

9. The method of claim 8 wherein the container is placed on a road chassis.

10. The method of claim 8 wherein the $1^{st}$ and $2^{nd}$ cradles are the same size as load-bearing capability.

11. The method of claim 8 wherein each coil between 14,200 and 19.000 lbs.

* * * * *